US006312086B1

(12) United States Patent
Saito et al.

(10) Patent No.: US 6,312,086 B1
(45) **Date of Patent: *Nov. 6, 2001**

(54) INK JET RECORDING APPARATUS HAVING SEPARATELY DISPOSED RECOVERY AND INK DETECTION DEVICES

(75) Inventors: Atsushi Saito, Yokohama; Takeshi Kohno, Kawasaki; Takashi Ono, Yokosuka; Shinichiro Kohri, Kawasaki; Yukio Nohata, Yokohama; Shigeyuki Sugiyama, Hiratsuka, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/671,584

(22) Filed: Jun. 28, 1996

(30) Foreign Application Priority Data

Jul. 4, 1995 (JP) ..... 7-168568

(51) Int. Cl.[7] ..... B41J 2/165
(52) U.S. Cl. ..... 347/22; 347/7; 347/29
(58) Field of Search ..... 347/22–23, 29–30, 347/35–36, 19, 81, 6, 7

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,166,707 | 11/1992 | Watanabe et al. | 347/3 |
| 5,437,444 * | 8/1995 | Kawakami et al. | 271/22 |
| 5,455,608 * | 10/1995 | Stewart et al. | 347/35 |
| 5,471,230 | 11/1995 | Saito et al. | 347/29 |

FOREIGN PATENT DOCUMENTS

| | | | |
|---|---|---|---|
| 0443832 | 8/1991 | (EP) | H04N/1/034 |
| 0568173 | 11/1993 | (EP) | B41J/2/125 |
| 54-56847 | 5/1979 | (JP) | B41M/5/26 |
| 56-046767 | 4/1981 | (JP) | B41J/3/04 |
| 58-171966 | 10/1983 | (JP) | B41J/3/04 |
| 59-123670 | 7/1984 | (JP) | B41J/3/04 |
| 59-138461 | 8/1984 | (JP) | B41J/3/04 |
| 60-71260 | 4/1985 | (JP) | B41J/3/04 |
| 63-260449 | 10/1988 | (JP) | B41J/3/04 |
| 1-130948 | 5/1989 | (JP) | B41J/3/04 |
| 6-115097 * | 4/1994 | (JP) | 347/37 |

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

An ink jet recording apparatus for recording on a recording medium by using an ink jet recording head for discharging ink includes a conveying device for conveying the recording medium, the conveying device defining a conveyance path through which the recording medium is conveyed, a carriage for reciprocally moving the ink jet recording head across the conveyance path, a recovery device for recovering and/or for maintaining a discharge function of the ink jet recording head, and an ink detecting device for detecting ink discharged from the ink jet recording head, wherein the conveyance path is disposed between the recovery device and the ink detecting device.

8 Claims, 3 Drawing Sheets

INK JET RECORDING APPARATUS HAVING SEPARATELY DISPOSED RECOVERY AND INK DETECTION DEVICES

BACKGROUND OF THE INVENTION

1. Field of the Invention

The present invention relates to an ink jet recording apparatus. More particularly, the invention relates to an ink jet recording apparatus capable of detecting the presence and absence of ink with good precision.

2. Related Background Art

There have been proposed various recording apparatuses that record on a paper sheet, a resin sheet, or other recording media. Of those apparatuses that have been proposed conventionally, an ink jet recording apparatus is to discharge ink from its recording head onto a recording medium directly. It is possible to operate the ink jet recording apparatus at low running costs with a lesser amount of noises. Therefore, together with other advantages, the apparatus is now widely used.

Also, in general, an ink jet recording apparatus is provided with recovery means for maintaining and recovering the ink discharging function of an ink jet recording head mounted on it. This recovery means comprises, among others, a cap member to cover the ink discharge ports of the ink jet recording head, and receive ink discharged from the ink discharge ports; a blade formed by an elastic material or the like to clean the head surface by sliding on the head surface having the ink discharge ports; a driving source to enable the cap member to be in contact with or move away from the head, and the blade to move slidably; and a pumping mechanism to cause the waste ink, which has been discharged to the interior of the cap member, to be exhausted outside the cap member.

A serial type ink jet recording apparatus is arranged to mount an ink jet recording head on a carriage that reciprocates for recording on a recording medium. This apparatus is provided with a recording area within the traveling range of the carriage, where ink jet recording is possible on a recording medium (in general, a platen is arranged on this recording area), and also, with a non-recordable area on one end portion adjacent to such recording area, where the aforesaid recovery means is inclusively arranged.

Among those ink jet recording apparatuses, there are some for which detection means is provided to detect ink. For the structure of such detection means, a method is adopted, among some others, to provide a recording medium or a film sheet with a mark for use of detecting the presence and absence of ink, and then, to detect whether or not such mark is recorded by means of a photosensor or a method is adopted to discharge ink between the light emitting element and photodetecting element of a photointerrupter, and then, to detect the presence and absence of ink by the output that changes when ink crosses the optical axis of the photointerrupter.

However, with respect to the ink detection structures described above, there is a need for a structure in which a mark should be recorded directly on a recording medium or a film sheet for detecting the presence and absence of ink. This is the provision of a mark that is not fundamentally needed for the performance of any regular recording, although the detection can be effectuated in high precision by means of this method.

Also, for the method to detect the presence and absence of ink by means of output changes when ink crosses the optical axis of a photointerrupter, there is a need for the provision of a system to collect discharged ink as waste ink, simply because ink should be discharged to execute such detection. Therefore, the location where this detection is conveyed out is usually arranged in the vicinity of a suction pump, which is used for preventing the recording head from being clogged. In this way, it is made possible to share the waste ink disposition system for use of such detection and prevention. Nevertheless, the optical components constituting the photointerrupter are stained by ink splash from the blade provided for wiping off unwanted ink droplets adhering to the circumference of nozzles of the head after ink is sucked by the suction pump, as well as by ink splash from some other peripheral members of the blade. If the optical components are stained, there is a fear that detection is erroneously executed.

SUMMARY OF THE INVENTION

The present invention is designed with a view to solving the problems described above with respect to the conventional technique. It is an object of the invention to provide an ink jet recording apparatus capable of performing ink detection in good precision without staining the components used during ink detection.

It is another object of the invention to provide an ink jet recording apparatus provided with a carriage for enabling an ink jet type recording head to travel along a recording medium while discharging ink for recording; head recovery means for maintaining the function of the recording head; ink detection means for detecting the presence and absence of ink discharged from the recording head; and conveying means for conveying the recording medium. For this apparatus the head recovery means and the ink detection means are arranged on the sides opposite to each other with the conveying path of a recording medium between them.

It is still another object of the invention to provide an ink jet recording apparatus capable of detecting the presence and absence of ink accurately without any malfunction of ink detection means resulting from ink stains by arranging the ink detection means and recovery means on the sides opposite to each other. The optical components of the ink detection means of this apparatus are prevented from being stained by ink splash from a suction pump, a blade, and the like, which constitute the recovery means.

It is a further object of the present invention to provide an ink jet recording apparatus for recording on a recording medium by discharging ink onto the recording medium, which including the following:

conveying means for conveying a recording medium in the recording medium conveying path;

a carriage mounting on it an ink jet recording head to discharge ink, being movable in an area including the area for the carriage to face the recording medium in the recording medium conveying path;

recovery means for recovering or maintaining the ink discharge function of the ink jet recording head, being arranged in an area outside the recording medium conveying path: this area enables the recovery means to face the carriage; and ink detection means for detecting the presence and absence of ink discharged from the ink jet recording head, which is arranged on the side opposite to the installation location of the recovery means with the recording medium conveying path being present between them: this side enables ink detection means to face the carriage.

DETAILED DESCRIPTION OF THE PREFERRED EMBODIMENTS

Figure 1:
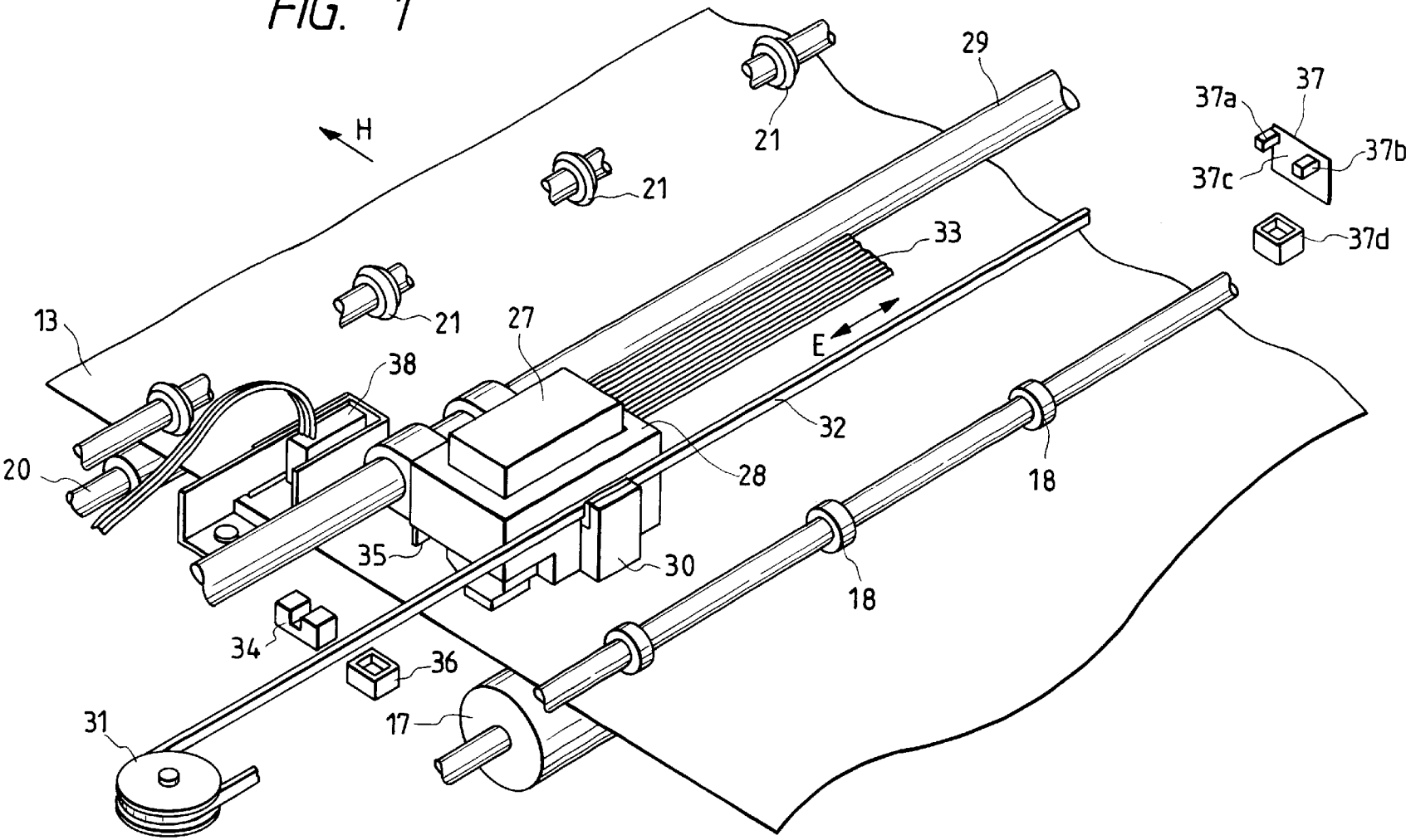
FIG. 1 is a view which schematically illustrates an ink jet recording apparatus in accordance with one embodiment of the present invention.
Figure 2:
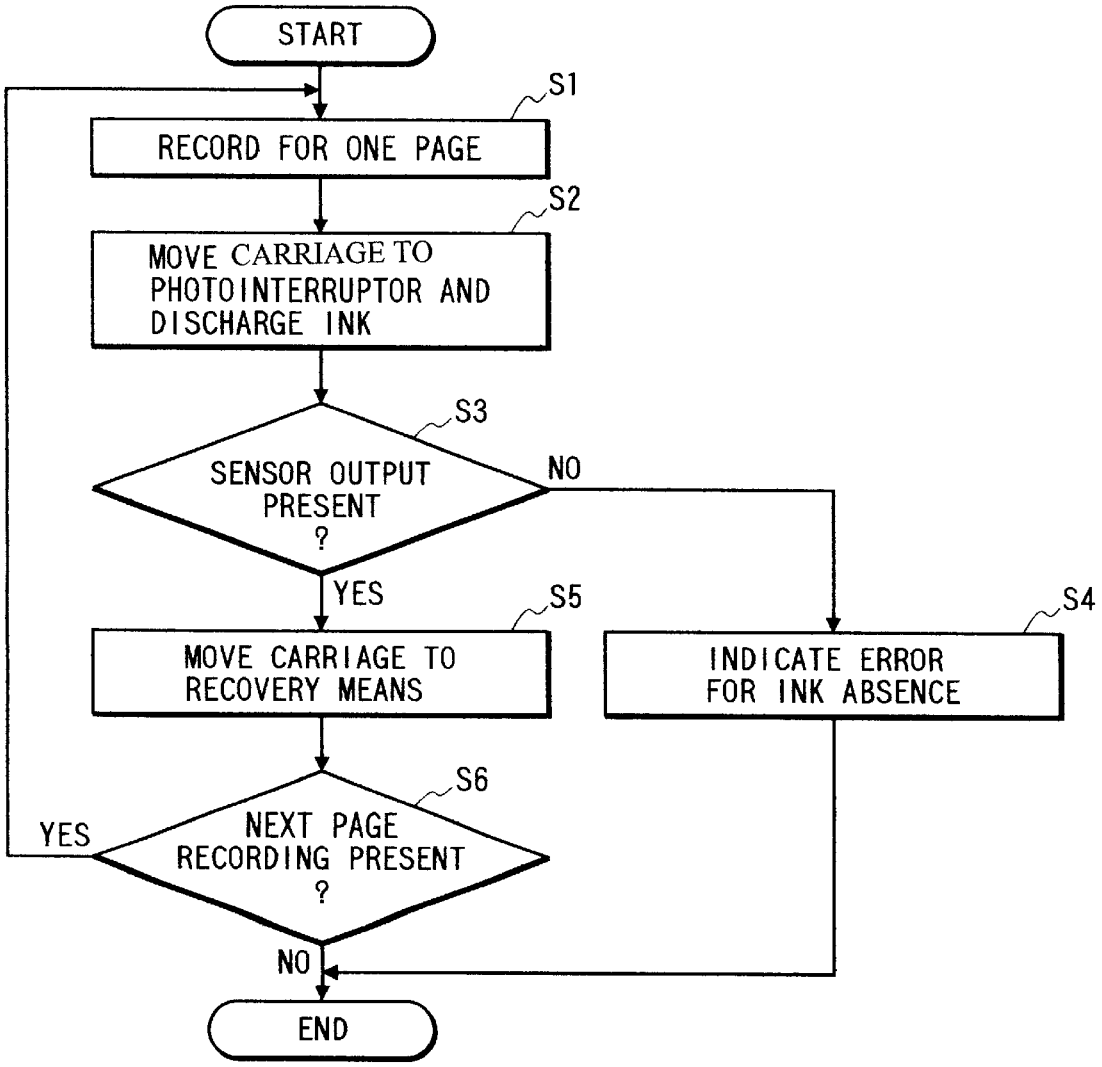
FIG. 2 is a flowchart which shows the procedures to detect presence and absence of ink.
Figure 3:
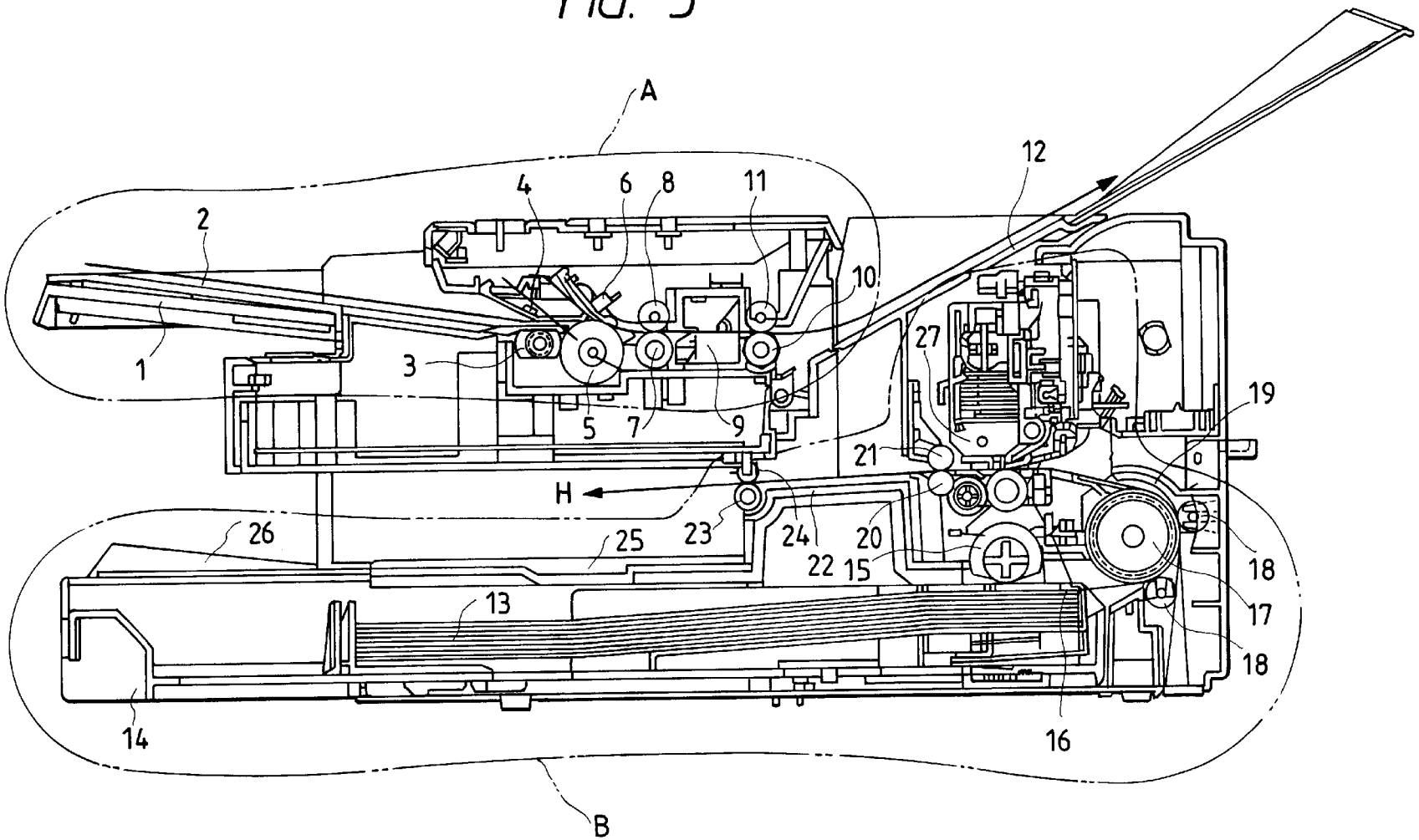
FIG. 3 is a view which schematically illustrates the entire structure of a facsimile equipment using a recording apparatus in accordance with the present invention.

Now, with reference to FIG. 1 to FIG. 3, the specific description will be made of an ink jet recording apparatus in accordance with an embodiment of the present invention. In this respect, FIG. 1 is a structural view which schematically shows the principal part of an ink jet recording apparatus. FIG. 2 is a flowchart showing the procedures to detect the presence and absence of ink. FIG. 3 is a view which schematically shows the entire structure of a facsimile equipment using the recording apparatus.

As shown in FIG. 3, the facsimile equipment is provided with a source document reading apparatus A to read information on a source document, and a recording apparatus B to record information read by the reading apparatus A or by the other reading apparatus. The recording apparatus B is an ink jet recording apparatus provided with means for detecting the presence and absence of ink. Hereinafter, the structure of each unit will be described.

(Structure of Source Document Reading Apparatus)

As shown in FIG. 3, a source document reading apparatus A detects the presence of a source document by means of a detection sensor (not shown) to detect the presence and absence of a source document when one or plural sheets of source documents 2 on a source document stacking tray 1 arranged on the upper part of the main body of the apparatus. When the operator depresses a start button (not shown) in this state, a stepping motor (not shown) is driven to cause a preliminary feed roller 3 to rotate. With this roller and a preliminary pressure plate 4, the source document 2 is pinched to deal with the leading end thereof.

After that, the source document 2 is conveyed to a separation unit comprising a separation roller 5 driven by the stepping motor described above, and a unit 6 of friction pieces. If the source documents are stacked, these documents are separated one by one in this separation unit. Then, each one of the source documents is pinched and conveyed by the feed roller 7 driven by the stepping motor, and a roller 8 positioned to face the feed roller 7, and by means of a sensor (not shown) that detects the leading and trailing ends of a source document, the leading end of the source document 2 is detected.

While the image information on the source document 2 is being read by means of a contact sensor 9 serving as means for reading a source document, the trailing end of the source document 2 thus conveyed is detected by the aforesaid sensor to read the leading and trailing ends of a source document. Then, an exhaust roller 10 driven by the stepping motor described above is caused to rotate for a given amount in accordance with the output from the sensor to detect the leading and trailing ends of a source document. In cooperation with an exhaust roller 11 arranged to face this roller 10, the source document is pinched and conveyed onto a cover 12 serving dually as a source document exhaust tray.

The structure is arranged in this way to transform the information on the source document thus read into electric signals, which are transmitted to the recording apparatus B if the process is in the copying mode, or to a recording apparatus of the other equipment if the process is in the transmitting mode.

(Structure of Recording Apparatus)

Now, the structure of a recording apparatus B will be described. This recording apparatus B is to record by recording means while a recording medium 13 is being fed by feeding means.

(Feeding Means)

A recording medium 13, which is a cut sheet of a standardized size, is placed one upon another to form a stack of plural sheets thereof and stored in a cassette 14. Then, feeding means conveys one by one from this stack in accordance with the recording operation. This cassette 14 is detachably mountable on the main body of the apparatus. In accordance with this mode embodying the present invention, a universal cassette is used to store recording sheets of various standardized sizes in it.

Each recording medium 13 stored and stacked in the cassette 14 described above is picked up by the feed roller 15 and a separation nail 16, and pinched and conveyed by means of a carrier roller 17 and a roller 18 positioned to face this carrier roller. The recording medium is then U-turned through a turn over guide 19.

A given recording is performed on the recording medium 13 thus conveyed, and after recording, the recording medium 13 is pinched and conveyed by the exhaust roller 20 and spur 21 positioned to face the exhaust roller 20. Here, the spur is formed by a material that does not allow ink to be transferred to it even when the spur abuts upon the recorded surface of the recording medium. Then, the recording medium is guided through a rear guide 22 formed by a plurality of ribs, and exhausted by means of a second exhaust roller 23 and a second spur 24 into a cassette cover 26, which dually serves as an exhaust rib 25 provided for the main body of the apparatus, and an exhaust tray.

Here, in FIG. 1, a reference numeral 38 designates a jam sensor arranged on the recording medium conveying path for detecting a jammed (sheet clogging) condition of a recording medium 13 to be conveyed.

Also, the cover 12, which becomes the source document exhaust portion, is arranged to be opened and closed with respect to the main body of the apparatus. When the cover is open, a space needed for replacing recording heads, which will be described later, is released, and also, a space above the rear guide 22 is released simultaneously.

(Recording Means)

As recording means for recording a given image on the recording medium 13, a serial type ink jet recording method is adopted for this mode embodying the present invention. As shown in FIG. 1 and FIG. 3, a cartridge type is employed so that the ink jet recording head 27 having an ink tank incorporated therein, is detachably mounted on the carriage 28, and the recording head 27 is replaced entirely with a new one when ink is completely consumed.

The carriage 28 is supported slidably in the direction indicated by an arrow E (main scanning direction) in FIG. 1 by means of a guide shaft 29 and an abutting member arranged in the direction rectangular to the conveying direction (sub-scanning direction) of the recording medium 13 indicated by an arrow H. The carriage 28 is coupled to a timing belt arranged like an endless belt, which is tensioned around pulleys arranged on both ends of the guide shaft 29 (only a pulley on one end is shown). Thus, the carriage can reciprocate in the main scanning direction when the pulley 31 on one end is driven by a carriage motor (not shown).

When the carriage travels, the recording head 27 discharges ink in accordance with image signals to record a given image on the recording medium 13.

The ink jet recording head 27 used in this mode embodying the present invention comprises fine liquid discharge ports (orifices); energy activation portions arranged for liquid paths and a part of the liquid paths; and energy generating means for generating the droplet formation energy that acts upon liquid in the energy activating portion.

As energy generating means for generating the energy described above, there is, among others, a recording method that uses electromechanical transducing elements, such as piezoelectric elements; a recording method that uses energy generating means for discharging droplets by the action of heat generated by irradiating electromagnetic waves, such as leaser; or a recording method that uses energy generating means for discharging droplets by heating liquid by use of electrothermal transducing elements, such as heat generating elements having heat resistive elements.

Of these means, a recording head used for the ink jet recording method that discharges ink by the application of thermal energy makes it possible to arrange liquid discharge ports (orifices) in a high density to discharge liquid for the formation of droplets in order to perform recording in high resolution. Of such recording heads, a recording head that uses electrothermal transducing elements as energy generating means is easily made compact. Also it is possible for this recording head to fully utilize the advantages of the IC technologies and microprocessing techniques whose advancement and reliability have been remarkable in recent years in the field of semiconductors. Therefore, a highly densified assembling of the head is possible at low costs of manufacture.

The resolution of a recording head 27 of this mode embodying the present invention is 360 DPI with 128 nozzles. Electric signals are supplied to the electrothermal transducing elements arranged in the nozzles through a flexible cable 33, respectively, and by the application of heat selectively generated in accordance with such signals, pressure is exerted in ink by film boiling thus created. Ink is then discharged from the respective discharge ports arranged at the leading end of nozzles to form inked images on a recording medium.

The home position of the carriage 28 is at one end of the traveling range of the carriage 28. It is arranged to enable the carriage 28 to be on standby on the home position when recording is at rest. A carriage home sensor 34 is also arranged in this home position, while a light shielding plate 35 is provided at the lower part of the carriage 28. The sensor 34 is a photointerrupter of light transmission type. When the carriage 28 travels to the home position, its light shielding plate 35 interrupts the light emitted from the light emitting element of the sensor 34. The arrival of the carriage 28 at the home position is detected by the change of signals obtainable by this sensor arrangement.

In the state of the carriage 28 having arrived at the home position, a cap 36 serving as recovery means of the recording head 27 is arranged and positioned to face the nozzles of the recording head 27. The cap 36 is structured to move up and down. At the time of recording, the cap descends. When recording is at rest and the carriage 28 arrives at the home position, the cap ascends to be in contact closely with the recording head 27 and covers the nozzle portion thereof, hence preventing any dust particles from adhering to the nozzle portion, and also, preventing ink from being evaporated for the maintenance of the function of the recording head 27.

On the side opposite to the side where the cap 36 is arranged with the conveying path of the recording medium 13 being present between them, that is, the opposite side of the traveling range of the carriage 28, means for detecting ink is arranged to detect the presence and absence of ink droplets discharged from the recording head. This ink detection means is formed by the photointerrupter 37 by this mode embodying the present invention. When detecting the presence and absence of ink, the carriage 28 moves to a position above the optical axis 37*c* of the light emitting element 37*a* to the photodetecting element 37*b*. Here, although not shown in FIG. 1, a sensor, which is structured in the same manner as the sensor 34 that detects the presence of the carriage 28 at its home position, is arranged to detect the movement of the carriage 28 to this position of ink detection. In this way, it is detected that the carriage 28 has moved to such position. Also, in the position of ink detection, an ink receptacle member 37*d* is arranged to face the recording head 27. Ink discharged for ink detection is exhausted to a waste ink retainer (not shown) through a waste ink absorbent in the ink receptacle member 37*d*.

The detection as to whether or not enough ink remains in the ink tank of the recording head 27 to continue ink discharge is conveyed out by the procedures described in the flowchart shown in FIG. 2. In other words, the recording of a first page is executed at first (step S1). Then, the carriage 28 is caused to shift to the position of ink detection where the photointerrupter 37 is arranged. This is the side opposite to the home position of the carriage, and the side where the carriage is allowed to conduct discharging ink (step S2). At this juncture, if enough ink remains to make ink discharge possible, ink is discharged. The discharged ink droplet crosses the optical axis 37*c*, thus causing the output of the photointerrupter 37 to change. On the other hand, if not enough ink remains to continue ink discharge, no ink is discharged. No ink droplet crosses the optical axis 37*c*. Therefore, the photointerrupter does not change its output at all. By the application of such change of outputs, it is possible to detect the presence and absence of a specific amount of ink in the ink tank (step S3).

Then, if not enough ink remains in the ink tank to continue ink discharge, an error indication, the absence of ink, is displayed on the indication unit (step S4). Here, if ink is present, the carriage 28 is caused to travel to the home position (step S5) to determine whether or not a next page is to be recorded (step S6). If affirmative, the process returns to the step S1 for the continuation of recording.

With the structure described above, means for detecting ink is arranged on the side opposite to the side where means for recovering the function of a recording head is arranged with the conveying path of a recording medium 13 being present between them. As a result, there is no possibility that the photointerrupter 37 is stained by ink splash or the like at the time of capping executed by the cap 36. In this way, it is possible to prevent any causes that may lead to an erroneous detection due to the lowered output of the photointerrupter brought about by the stained surfaces of the light emitting and photodetecting elements.

(Other Modes Embodying the Invention)

Now, the description will be made of other modes embodying the present invention. For the mode described above in accordance with the present invention, a cap 36 that covers the recording head 27 is exemplified as means for recovering the function of recording head, but besides the capping means, the recovery means may be cleaning means using a blade or the like; pressure or suction means; preliminary heating means using elements of electrothermal transducing type or heating elements other than the electrothermal transducing type, or using them in combination; or a predischarge mode that executes discharge other than regular recording for the effective performance of a stabilized recording.

Now, the description will be made of a preferable structure of an ink jet recording method serving as recording means in this mode embodying the present invention described above. In accordance with such mode, the structure is arranged to discharge ink by the development and contraction of bubbles formed in ink by the utilization of film boiling created in it by the application of thermal energy generated by electro-thermal transducing elements. Regarding the typical structure and operational principle of such method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, for the on-demand type, at least one driving signal, which provides a rapid temperature rise beyond a departure from nucleation boiling point in response to recording information, is applicable to an electrothermal transducing element disposed on a liquid (ink) retaining sheet or liquid path whereby to cause the electrothermal transducing element to generate thermal energy to create film boiling on the thermoactive portion of the recording head, thus effectively leading to the resultant formation of a bubble in the recording liquid one to one in response to each of the driving signals. By the development and contraction of this bubble, the liquid is discharged through a discharge port to produce at least one droplet. The driving signal is more preferably in the form of pulses because the development and contraction of the bubble can be effectuated instantaneously, and, therefore, the liquid is discharged with quicker response.

The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducing elements (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention.

Also, the present invention is effectively applicable to the structure disclosed in Japanese Patent Application Laid-Open No. 59-123670 wherein a common slit is used as the discharging ports for plural electrothermal transducers, and to the structure disclosed in Japanese Patent Application Laid-Open No. 59-138461 wherein an aperture for absorbing pressure wave of the thermal energy is formed corresponding to the discharge ports.

In addition, it may be possible for the present invention to use a recording head of an exchangeable chip type, which can be electrically connected with the apparatus main body or to which ink can be supplied from the apparatus main body when it is installed in the apparatus main body, or a recording head of a cartridge type in which an ink tank is formed integrally with the recording head itself.

Also, for the kinds or the numbers of recording heads to be mounted on a carriage, it is possible to provide a plurality of heads for plural kinds of ink having different colors or densities besides a single head applicable to only a monochromatic ink. In other words, the present invention is applicable not only to a recording mode in which only main color such as black is used, but also to an apparatus having at least one of multi-color modes with ink of different colors, or a full-color mode using the mixture of the colors, irrespective of whether the recording heads are integrally structured or it is structured by a combination of plural recording heads.

Moreover, in the modes embodying the present invention described above, ink has been described as liquid, but it may be an ink material which is solidified below the room temperature but liquefied at the room temperature or the one which is liquefied by the provision of recording signal to be applied to discharging it.

In addition, the present invention is applicable to such a case in which, while positively preventing the temperature from rising due to the thermal energy by consuming such energy for changing states of ink from solid to liquid, or by using the ink which will be solidified when left intact for the purpose of preventing the ink from being evaporated, it is made possible to adopt ink having a nature of being liquefied only by the application of thermal energy, such as an ink capable of being discharged as ink liquid by enabling itself to be liquefied anyway when the thermal energy is given in accordance with recording signals, and the ink which will have already begun solidifying itself by the time it reaches a recording medium.

In such a case, it may be possible to retain ink in the form of liquid or solid in the recesses or through holes of a porous sheet such as disclosed in Japanese Patent Application Laid-Open No. 54-56847 or 60-71260 so as to allow ink to face the electrothermal transducers. In the present invention, the most effective method applicable to the various kinds of ink mentioned above is the one which is able to implement the film boiling method as described above.

Further, as the mode of the recording apparatus in accordance with the present invention, it is not necessarily limited to the mode of a facsimile equipment provided with the functions of transmission and reception. The present invention may be applicable to the mode in which a copying apparatus combined with a reader is used, besides the image output terminal for a computer, or other information processing apparatus.

In accordance with the present embodiment, means for detecting ink is arranged on the side opposite to the side where recovery means is arranged with the recording medium conveying path being present between them as has been described above. Therefore, it is possible to prevent the optical components of ink detection means from being stained by ink splash from the suction pump, blade, and others that constitute the recovery means. As a result, there is no possibility that the ink detection means is caused by ink stains to bring about any malfunctions. The presence and absence of ink can be detected accurately. When a recording apparatus of the present invention is adopted for use of a facsimile equipment, for example, it is possible to minimize the occurrence of errors, thus conveying out communication more reliably.

What is claimed is:

1. An ink jet recording apparatus for recording on a recording medium by using an ink jet recording head for discharging ink, said apparatus comprising:

conveying means for conveying the recording medium, said conveying means defining a conveyance path through which the recording medium is conveyed;

a carriage for reciprocally moving said ink jet recording head within a carriage travel range which includes moving across the conveyance path, the carriage being positioned to face the recording medium in the conveyance path;

recovery means for recovering a discharge function of said ink jet recording head, the recovery means being positioned in an area outside of the conveyance path at a first end of the carriage travel range and positioned to face the carriage; and ink detecting means for detecting ink discharged from said ink jet recording head, the ink detecting means being positioned at a second end of the carriage travel range and positioned to face the carriage, wherein the conveyance path is disposed between said recovery means and said ink detecting means, and wherein the recovery means and the ink detecting means are positioned at opposite ends of the carriage travel range.

2. An ink jet recording apparatus according to claim 1, wherein said ink detection means comprises a photointerrupter.

3. An ink jet recording apparatus according to claim 1, wherein said ink jet recording head is provided with electrothermal transducing elements, and said ink jet recording head discharges ink from ink discharge ports to record on said recording medium using thermal energy generated by said electrothermal transducing elements.

4. An ink jet recording apparatus according to claim 1, wherein said ink jet recording head is provided with electrothermal transducing elements, and said ink jet recording head discharges ink from ink discharge ports to record on said recording medium by using film boiling created in ink by thermal energy generated by said electrothermal transducing elements.

5. An ink jet recording apparatus for recording on a recording medium by using an ink jet recording head for discharging ink, said apparatus comprising:

a roller for conveying the recording medium, said roller spanning a conveyance path through which the recording medium is conveyed;

a carriage for reciprocally moving said ink jet recording head within a carriage travel range which includes moving across the conveyance path, the carriage being positioned to face the recording medium in the conveyance path;

a cap for recovering a discharge function of said ink jet recording head, the cap being positioned in an area outside of the conveyance path at a first end of the carriage travel range and positioned to face the carriage; and a sensor for detecting ink discharged from said ink jet recording head, the sensor being positioned at a second end of the carriage travel range and positioned to face the carriage, wherein the conveyance path is disposed between said cap and said sensor, and wherein said cap and said sensor are positioned at opposite ends of the carriage travel range.

6. An ink jet recording apparatus according to claim 5, wherein said sensor comprises a photointerrupter.

7. An ink jet recording apparatus according to claim 5, wherein said ink jet recording head is provided with electrothermal transducing elements, and said ink jet recording head discharges ink from ink discharge ports to record on said recording medium using thermal energy generated by said electrothermal transducing elements.

8. An ink jet recording apparatus according to claim 5, wherein said ink jet recording head is provided with electrothermal transducing elements, and said ink jet recording head discharges ink from ink discharge ports to record on said recording medium by using film boiling created in ink by thermal energy generated by said electrothermal transducing elements.

* * * * *

UNITED STATES PATENT AND TRADEMARK OFFICE

CERTIFICATE OF CORRECTION

PATENT NO. : 6,312,086 B1
DATED : November 6, 2001
INVENTOR(S) : Atsushi Saito et al.

It is certified that error appears in the above-identified patent and that said Letters Patent is hereby corrected as shown below:

Title page,
Item [56], References Cited, FOREIGN PATENT DOCUMENTS,
"0443832" should read -- A0443832 --; and
"0568173" should read-- A0568173 --.

Column 2,
Line 45, "including" should read -- include --.

Column 3,
Line 31, "1" should read -- 1 are --.

Signed and Sealed this

Thirtieth Day of April, 2002

*Attest:*

*Attesting Officer*

JAMES E. ROGAN
*Director of the United States Patent and Trademark Office*